US010680372B2

(12) United States Patent
Hwang et al.

(10) Patent No.: US 10,680,372 B2
(45) Date of Patent: Jun. 9, 2020

(54) ELECTRICAL CONTACT OF ELECTRICAL CONNECTOR

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventors: Tzu-Yao Hwang, New Taipei (TW); Kuo-Wei Chang, New Taipei (TW)

(73) Assignees: FU DING PRECISION COMPONENT (SHEN ZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/357,283

(22) Filed: Mar. 18, 2019

(65) Prior Publication Data

US 2019/0288431 A1 Sep. 19, 2019

(30) Foreign Application Priority Data

Mar. 16, 2018 (CN) ..... 2018 2 0357118 U
Mar. 16, 2018 (CN) ..... 2018 2 0358609 U

(51) Int. Cl.

| | |
|---|---|
| ***H01R 12/00*** | (2006.01) |
| ***H01R 13/24*** | (2006.01) |
| ***H01R 12/71*** | (2011.01) |
| ***H01R 33/74*** | (2006.01) |
| ***H01R 12/73*** | (2011.01) |
| ***H01R 12/58*** | (2011.01) |
| ***H01R 12/91*** | (2011.01) |
| *H01R 13/50* | (2006.01) |
| *H01R 12/70* | (2011.01) |

(52) U.S. Cl.

CPC ..... *H01R 13/2442* (2013.01); *H01R 12/585* (2013.01); *H01R 12/716* (2013.01); *H01R 12/732* (2013.01); *H01R 12/91* (2013.01); *H01R 33/74* (2013.01); *H01R 12/707* (2013.01); *H01R 13/50* (2013.01)

(58) Field of Classification Search

CPC .. H01R 13/2442; H01R 12/716; H01R 33/74; H01R 12/707; H01R 13/50

USPC ..... 439/626, 879, 66

See application file for complete search history.

(56) References Cited

U.S. PATENT DOCUMENTS 6,164,978 A * 12/2000 McHugh ..... H01R 12/52 439/66
6,955,572 B1 * 10/2005 Howell ..... H01R 13/2442 439/862

(Continued)

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

A plurality of contact are received within the corresponding passageways of the insulative housing of an electrical connector, respectively. Each contact has juxtaposed first body and second body angled with each other via a connecting section linked therebetween. A resilient contacting section extends upwardly from the first body. A spring arm extends upward from the first body and includes a wide plate section adjacent to the first body and a narrow bulged contacting section at a top thereof. During operation, the plate section is parallel to a top face of the housing in a compressed manner.

19 Claims, 15 Drawing Sheets

(56) References Cited

U.S. PATENT DOCUMENTS

| | | | | |
|---|---|---|---|---|
| 10,084,252 | B1 * | 9/2018 | Ju | H01R 12/707 |
| 2006/0040518 | A1 * | 2/2006 | Ma | H01R 13/2442 439/66 |
| 2008/0160841 | A1 * | 7/2008 | Polnyi | H01R 13/2435 439/842 |
| 2010/0015861 | A1 * | 1/2010 | Zhang | H05K 7/1007 439/733.1 |
| 2011/0014816 | A1 * | 1/2011 | Fan | H01R 12/57 439/626 |
| 2012/0028502 | A1 * | 2/2012 | Yeh | H01R 12/57 439/626 |
| 2012/0202384 | A1 * | 8/2012 | Liaw | H01R 12/57 439/626 |
| 2013/0237066 | A1 * | 9/2013 | Yeh | H01R 13/2457 439/65 |
| 2014/0134853 | A1 * | 5/2014 | Chang | H01R 13/6597 439/68 |
| 2014/0154918 | A1 * | 6/2014 | Chang | H01R 13/6585 439/607.01 |
| 2019/0288431 | A1 * | 9/2019 | Hwang | H01R 12/716 |
| 2019/0288432 | A1 * | 9/2019 | Cheng | H01R 13/2442 |
| 2019/0288454 | A1 * | 9/2019 | Hwang | H01R 13/2442 |

* cited by examiner

ELECTRICAL CONTACT OF ELECTRICAL CONNECTOR

BACKGROUND OF THE INVENTION

1. Field of the Invention

The present invention relates generally to an electrical contact, and more particularly to the electrical contact with structures meeting impedance requirements. This application relates to another copending application Ser. No. 16/355,857.

2. Description of Related Arts

U.S. Pat. No. 8,454,373 discloses en electrical contact of an electrical connector for use with a CPU (Central Processing Unit). The contact includes two juxtaposed and mutually angled parts, of which one has the resilient upwardly extending contacting section and the other has the stiff downwardly extending tail section. The feature of such patent is to provide the barbed structure on two lateral outer sides of the these two parts, respectively, for enhancing the retention force thereof compared with the earlier prior art having the barbed structure only on the part having the tail section. Anyhow, some unwelcomed deviation away from the regulated 85+/−15Ω of the contact occurs due to the positions and the dimensions of the contacting section and the tail section disadvantageously.

An improvement upon the contacting section and/or the tail section is desired.

SUMMARY OF THE INVENTION

An object of the invention is to provide an electrical connector with an insulative housing having opposite top and bottom faces thereof, and therein a plurality of passageways each extending through both the opposite top and bottom faces in the vertical direction. A plurality of contact are received within the corresponding passageways, respectively. Each contact has juxtaposed first body and second body perpendicular to each other via a connecting section linked therebetween viewed in the vertical direction. A spring arm extends upwardly from the first body and includes a wide plate section and a narrow bulged contacting section at a top end. The bottom portion of the second body forms sideward spaced first blade and second blade with a slit therebetween, wherein a soldering tail further extends form the first blade, and the second blade is sideward farther from the first body than the first blade is. In operation, the spring arm is downwardly deflected to have the plate section of the spring arm parallel to the soldering tail and also parallel to the corresponding conductive pad to which the contacting section is connected. Through the structure arrangement around the soldering tail, the unwelcomed deviation of the regulated impedance can be removed.

Figure 1:
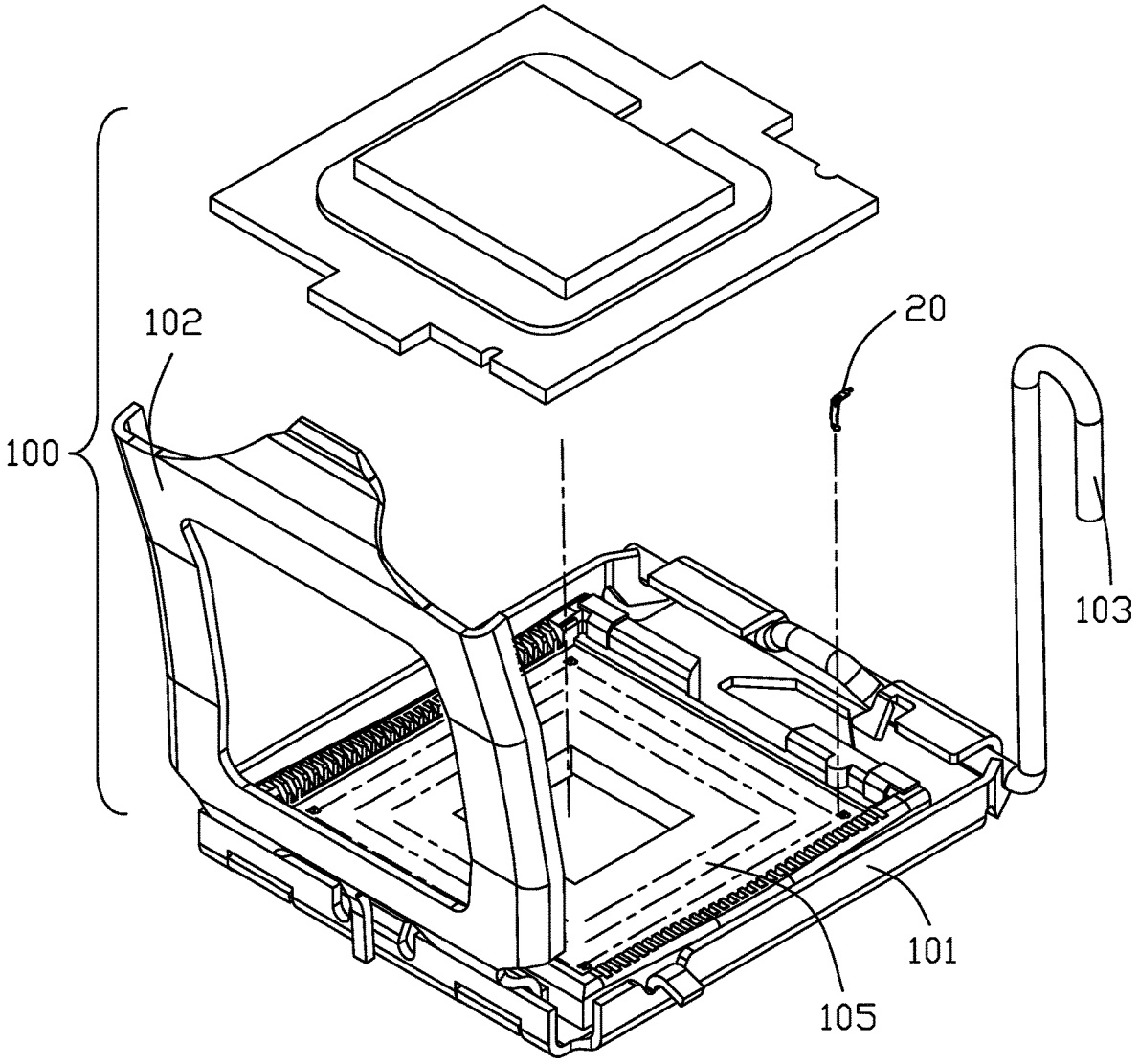
FIG. 1 is a perspective view of an electrical connector and the electronic package adapted to be received therein, according to a first embodiment of the present invention.
Figure 2:
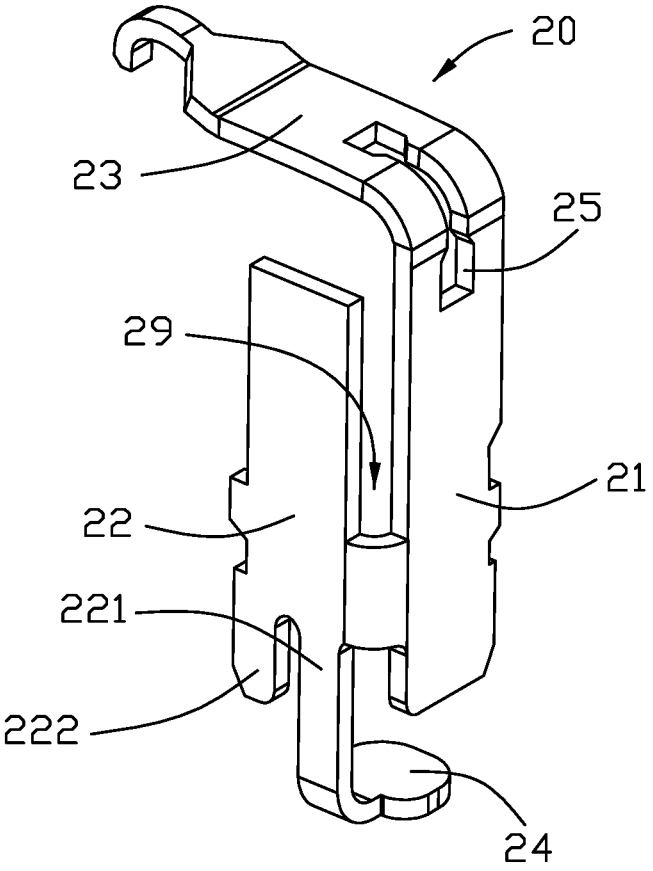
FIG. 2 is a perspective view of the electrical contact of the electrical connector of FIG. 1.
Figure 3:
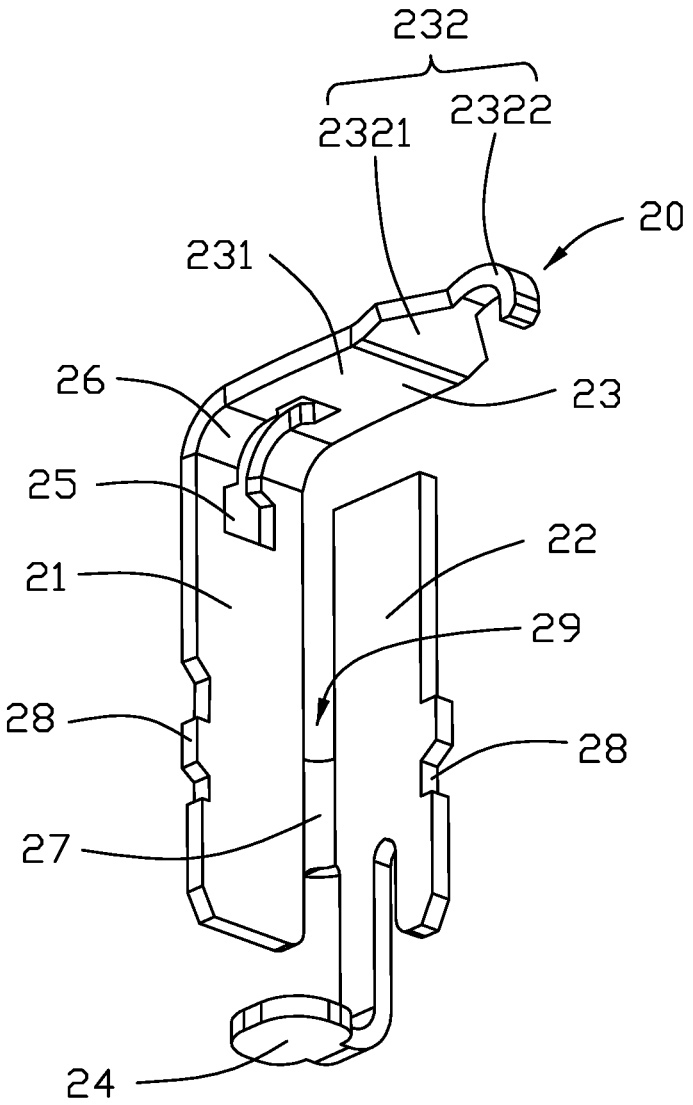
FIG. 3 is another perspective view of the electrical contact of the electrical connector of FIG. 1.

DETAILED DESCRIPTION OF THE PREFERRED EMBODIMENT the electrical connector 100 connects the electronic package 104 to the printed circuit board 106. The connector 100 includes an insulative housing 105 with a plurality of passageways (not labeled) to receive the corresponding contacts 20, respectively. The connector 100 further includes a metallic stiffener 101 surrounding the housing 105, and the load plate 102 and the lever 103 respectively pivotally mounted to two opposite ends of the stiffener 101.

The housing 105 forms opposite top face 1051 and bottom face 1052. The passageways extend through both the top face 1051 and the bottom face 1052. The contact 20 includes the first body 21 and the second body 22. A spring arm 23 extends upwardly from the first body 21 and above the top face 1051, and a horizontal soldering tail 24 is located below the second body 22. The spring arm 23 includes an wide plate section 231 and a narrow contacting section 232. The contacting section 232 includes a tapered transitional region 2321 linked to the plate section 231, and a bulged head 2322 for contacting the conductive pad of the electronic package 104.

The first body 21 and the second body 22 are of a plate configuration with a connecting section 27 linked therebetween. In this embodiment, the first body 21 and the second body 22 are perpendicular to each other, viewed in the vertical direction, and connected to each other via a connecting section 27 so as to form a slit 29 among the first body 21, the second body 22 and the connecting section 27 for adjusting impedance.

In this embodiment, the first body 21 and the wide plate section 231 have the same width. A pair of barbed structures 28 are formed on opposite lateral outer edges of the first body 21 and the second body 22, respectively. A first blade 221 and a second blade 222 extend downwardly from a bottom edge of the second body 22. The soldering tail 24 extends from a bottom end of the first blade 221. A solder ball 30 is attached to an undersurface of the soldering tail 24. A slit 31 is formed between the first blade 221 and the second blade 222 with a width around 0.10 mm~0.25 mm and a length around 0.25 mm~0.40 mm for adjusting impedance.

In this embodiment, the spring arm 23 forms an elongated slot 25 along an extension direction thereof around the curved adjoining or bending section 26, and the slot 25 essentially extends from the first body 21 to the spring arm 23 and through the contact 20 in the thickness direction.

A width of the slot 25 is not more than one third of the width of the adjoining/bending section 26. In this embodiment, two opposite ends of the slot 25, which are respectively in the first body 21 and the plate section 231 wider than the remaining portion thereof. Alternately, other shapes like rectangle or oval may be acceptable. In other words, because of existence of the slot 25 in the contact 20 which may lower rigidity of the spring arm 23 for upwardly pressing the corresponding conductive pad of the electronic package 104, the width of the first body 21 or the plate section 231 of the spring arm 23 may be properly enlarged to decrease the distance between the neighboring contacts 20 so as to lower the impedance thereof.

Figure 4:
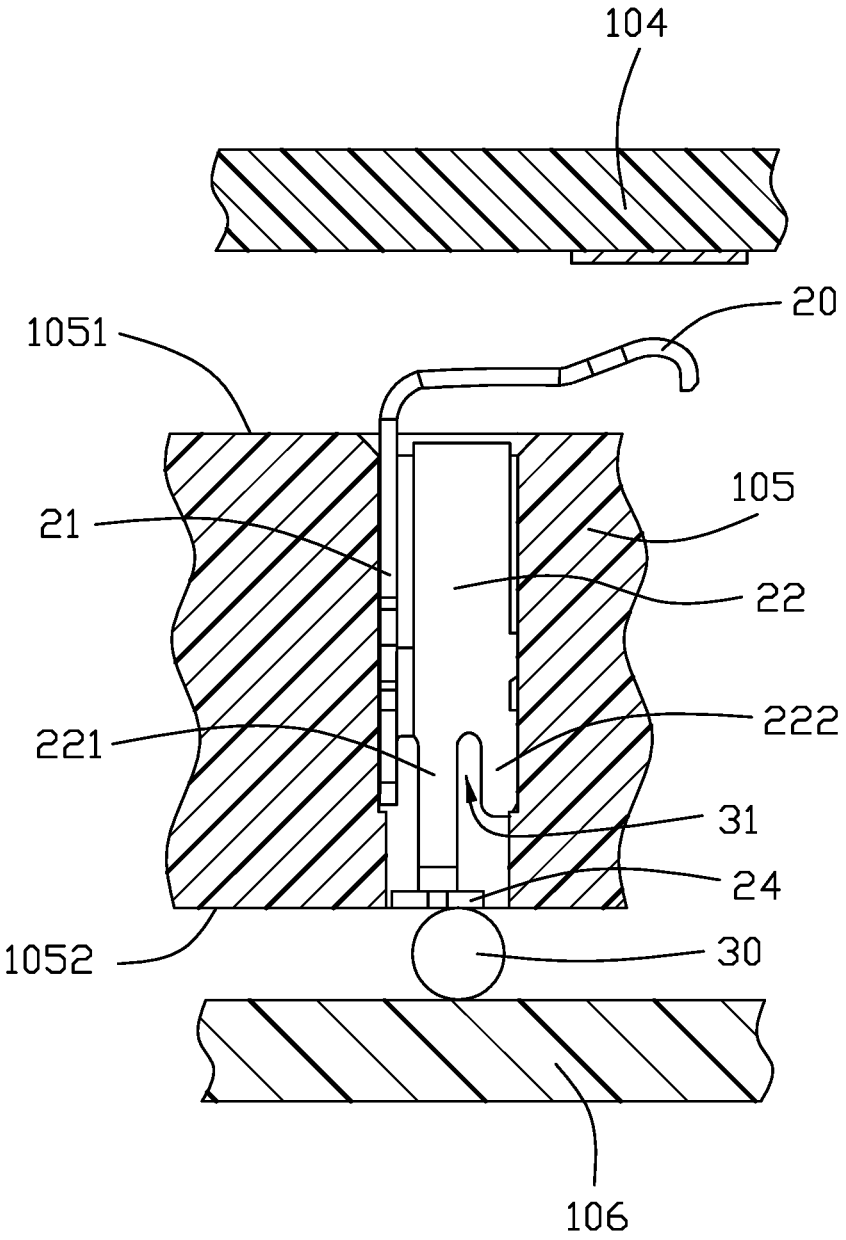
FIG. 4 is a cross-sectional view of the electrical connector and the associated electronic package of FIG. 1 and further a printed circuit board on which the electrical connector is mounted.
Figure 5:
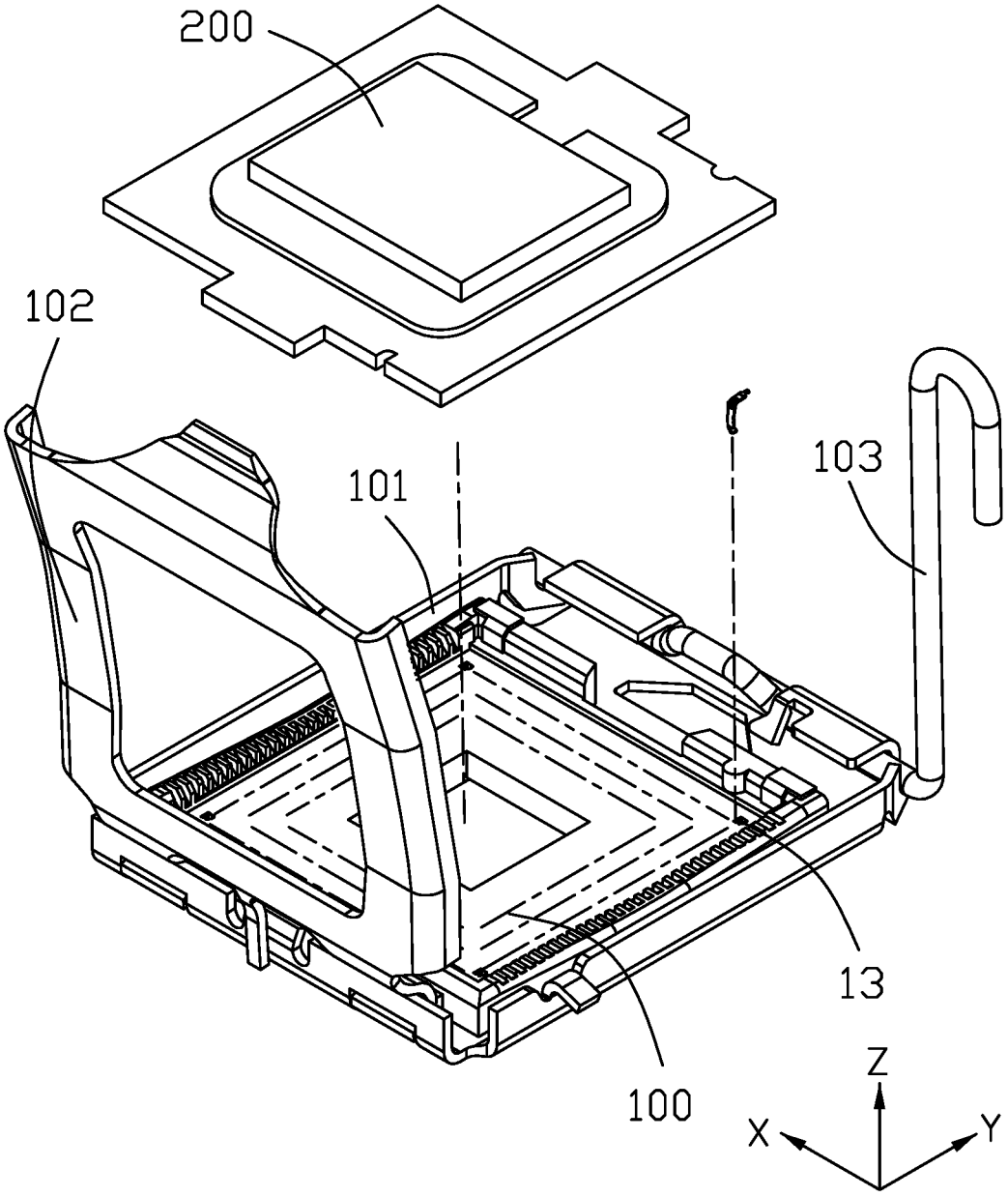
FIG. 5 is a perspective view of the electrical connector according to a second embodiment of the present invention.
Figure 6:
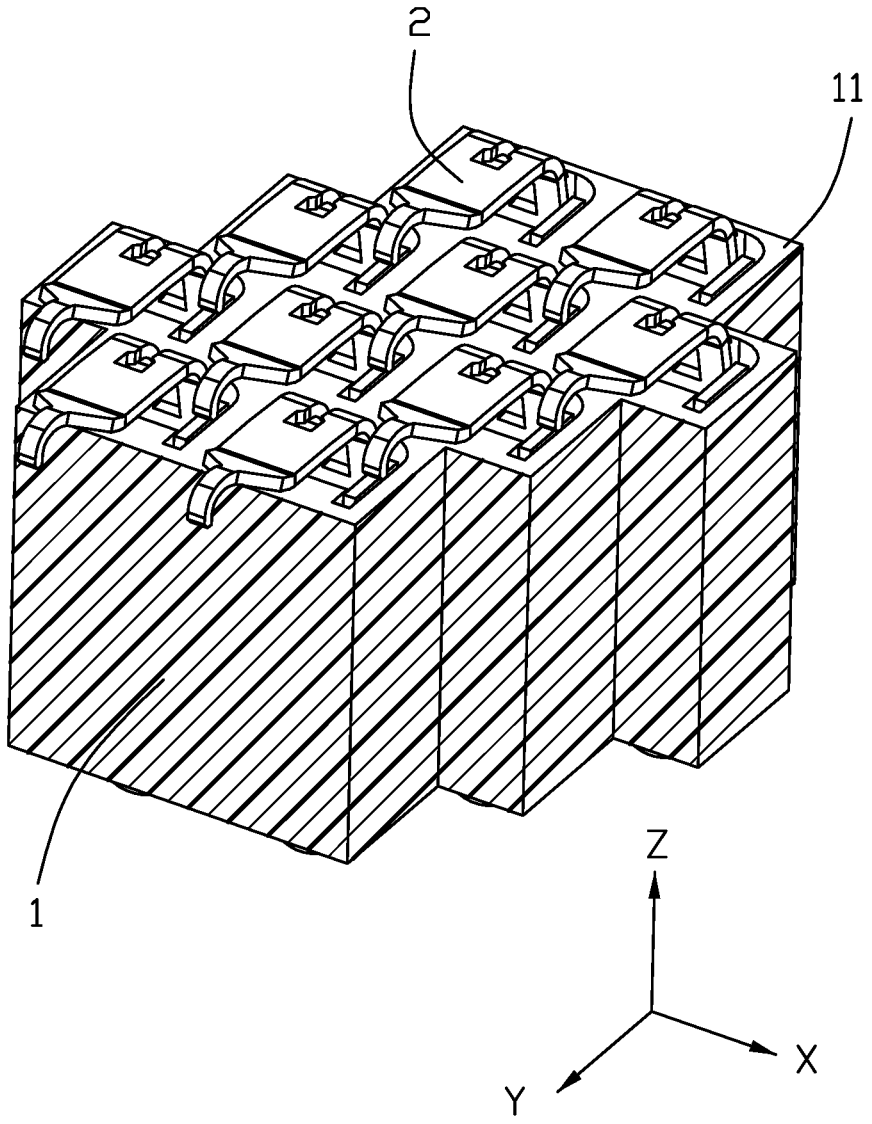
FIG. 6 a perspective view of a portion of the electrical connector of FIG. 5.
Figure 7:
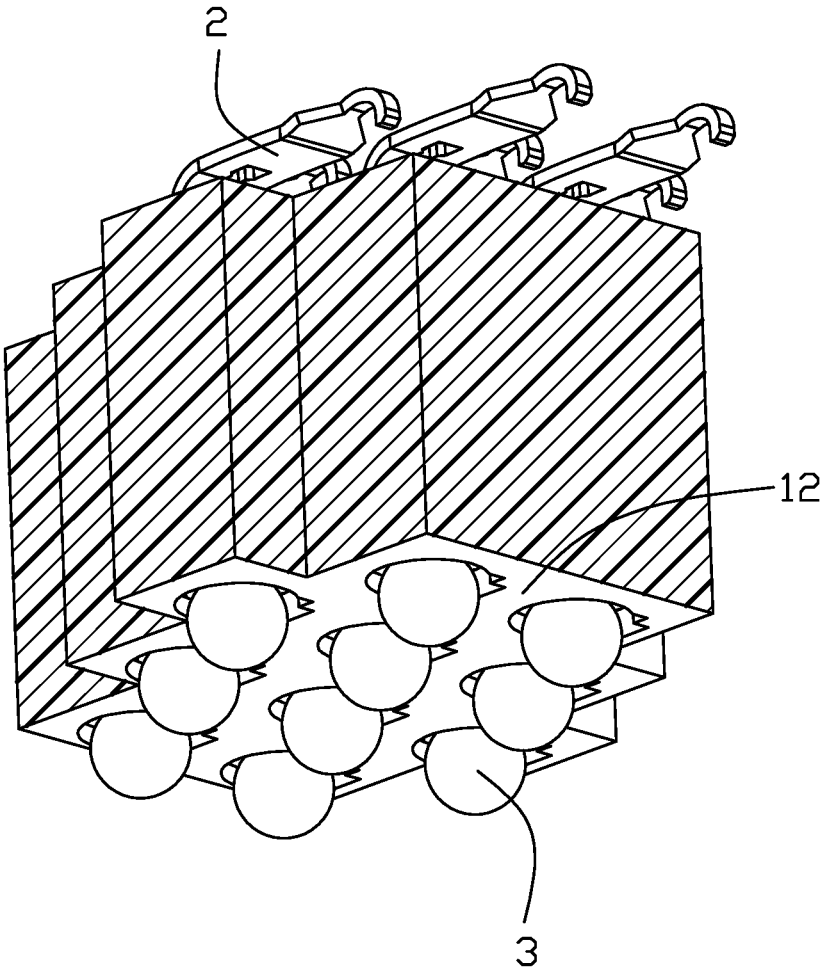
FIG. 7 is another perspective view of the portion of the electrical connector of FIG. 6.
Figure 8:
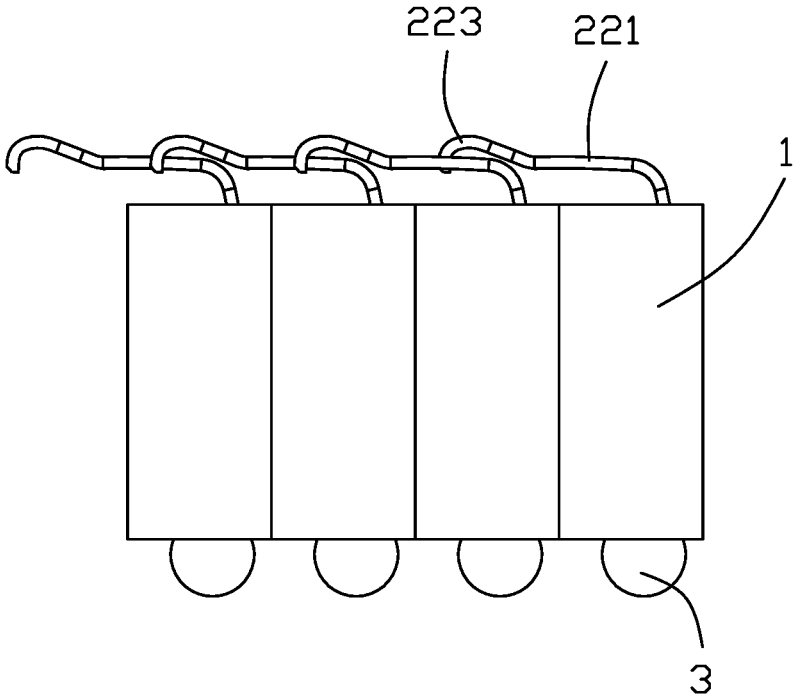
FIG. 8 is a side view of the portion of the electrical connector of the electrical connector of FIG. 6.
Figure 9:
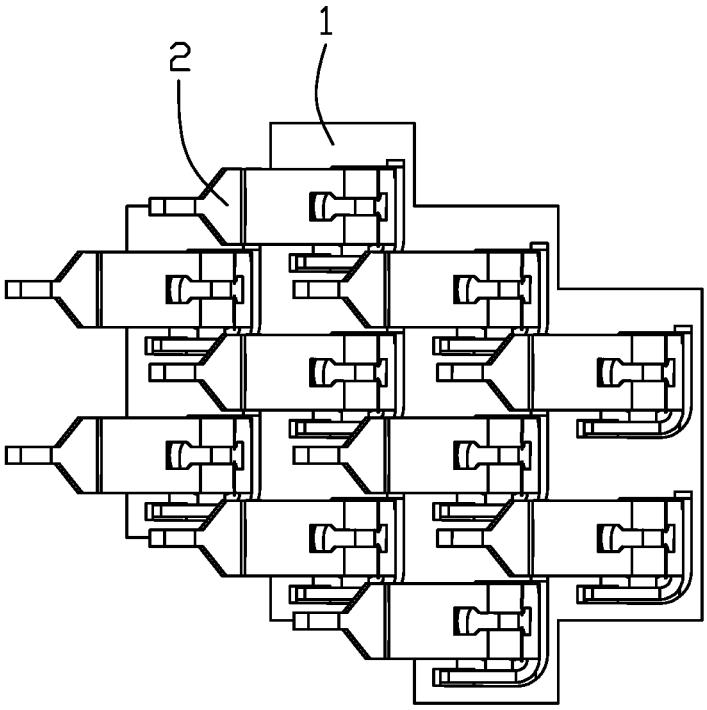
FIG. 9 is a top view of the portion of the electrical connector of FIG. 6.
Figure 10:
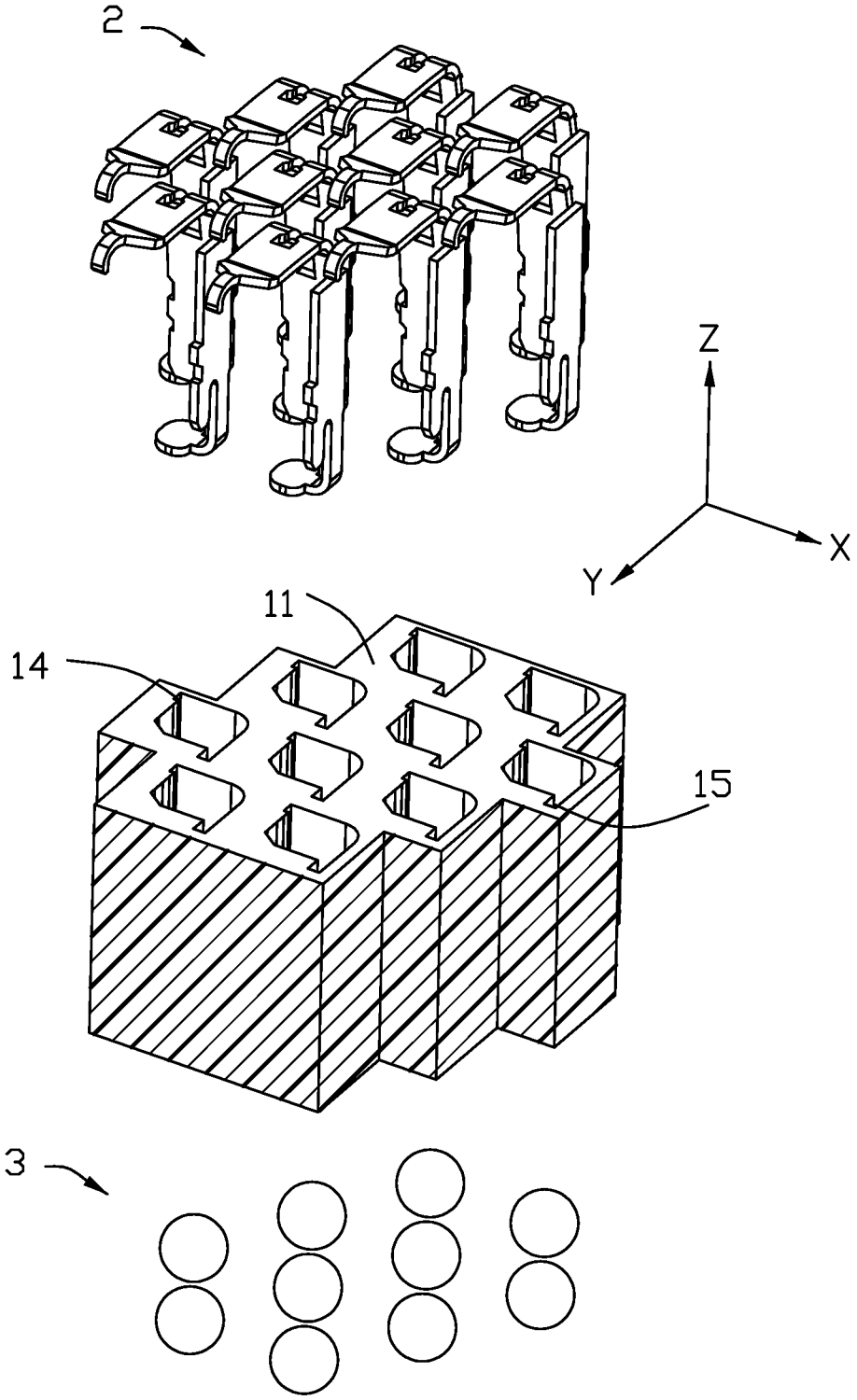
FIG. 10 is an exploded perspective view of the portion of the electrical connector of FIG. 6.
Figure 11:
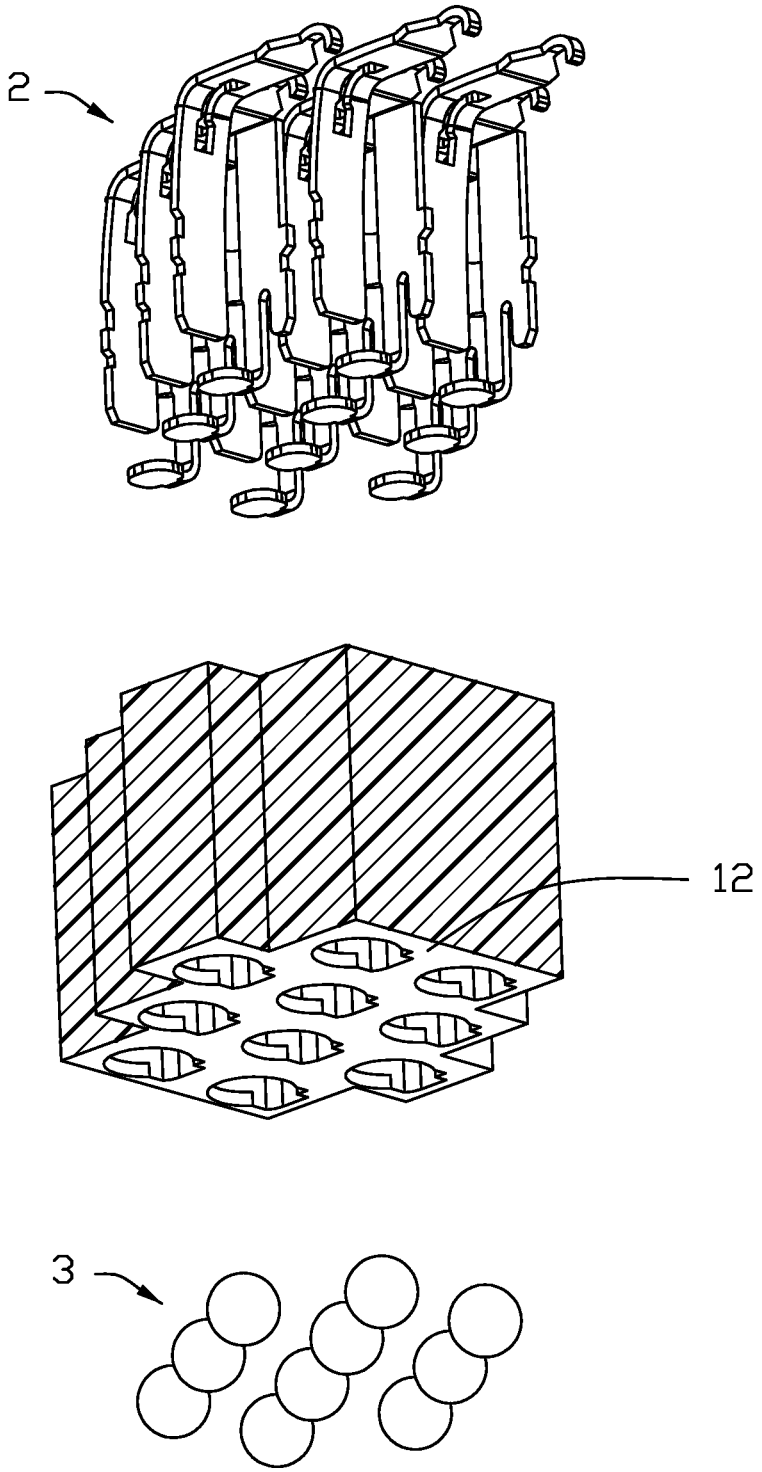
FIG. 11 is another exploded perspective view of the portion of the electrical connector of FIG. 6.
Figure 12:
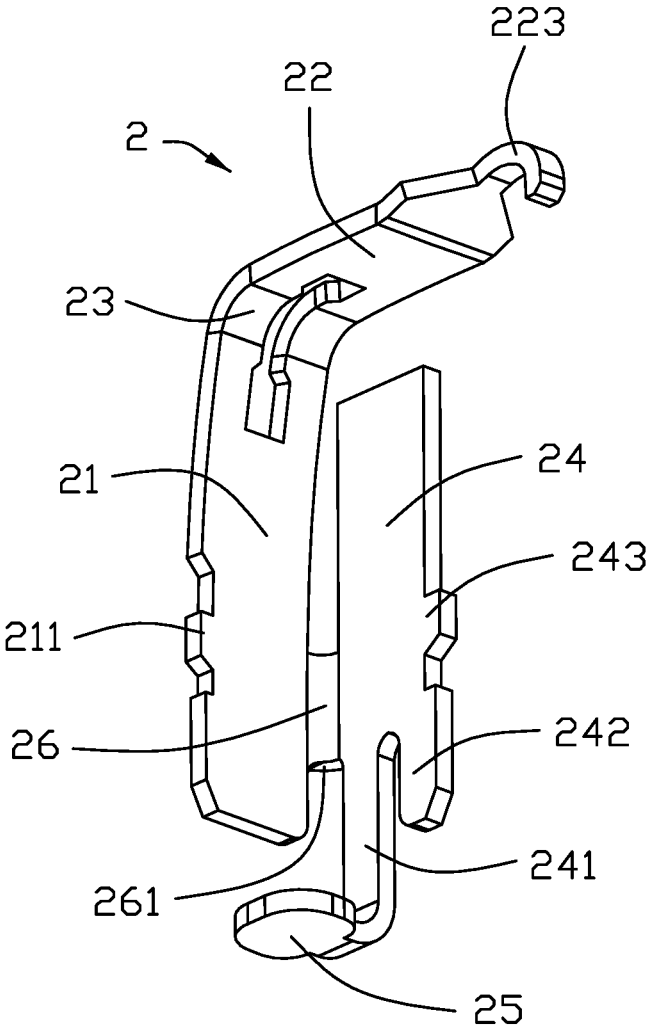
FIG. 12 is a perspective view of the contact of the electrical connector of FIG. 5.
Figure 13:
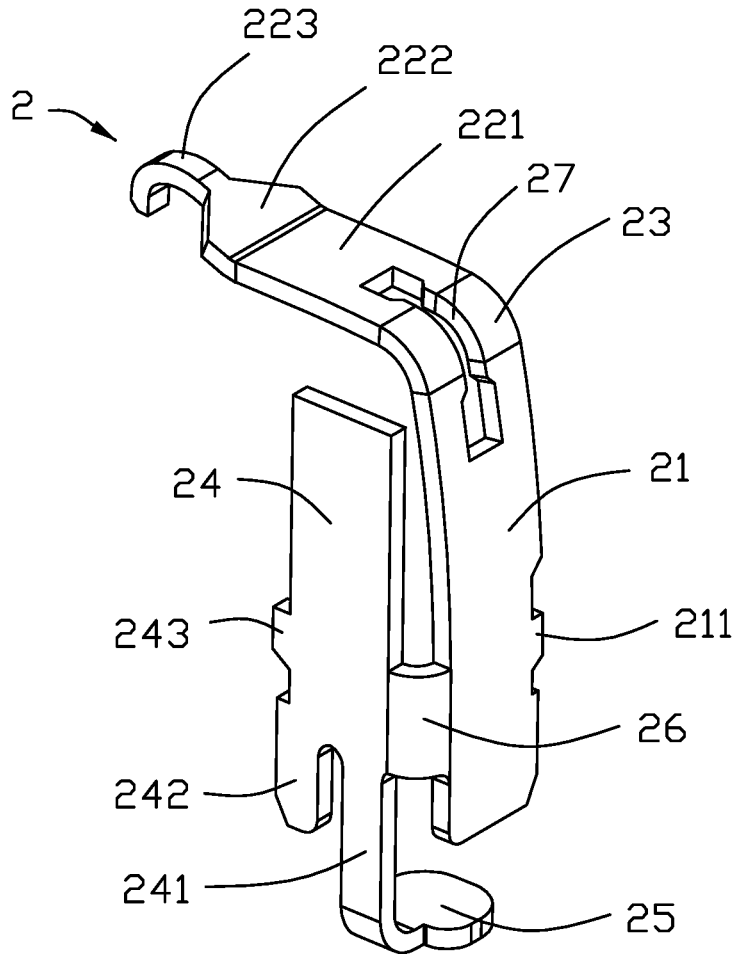
FIG. 13 is another perspective view of the contact of electrical connector of FIG. 12.

In this embodiment, because the first body 21 and the second body 22 are perpendicular to each other so as to form a capacitance effect for lowering impedance thereof. At the same time, the slot 25 in the spring arm 23, the slit 31 between the first blade 221 and the second blade 222, and the slit 29 between the first body 21 and the second body 22 also help to adjust the desired impedance thereof. FIG. 4 shows the contact either in a relaxed manner without contacting the electronic package 104 or in a compressed manner by be downwardly pressed by the electronic package 104.

Referring to FIGS. 5-15, an electrical connector 100 for electrically connecting the electronic package 200 to the printed circuit board 300, includes an insulative housing 1 with a plurality of passageways 13 to securely receive a plurality of corresponding contacts 2 therein. A plurality of solder balls 3 are attached to the corresponding contacts 2, respectively. The electrical connector 100 further includes a stiffener 101 surrounding the housing 1, a load plate 102 pivotally mounted to one end of the stiffener 1 for holding the electronic package 200 in the housing 1, and a lever 103 pivotally mounted to the other end of the stiffener 1 for securing the load plate 102 in position. In the embodiment, for describing the contact 2, it is defined with the vertical direction Z, the front-to-back direction Y and the transverse direction X which are perpendicular with one another.

The housing 1 forms two opposite top face 11 and bottom face 12. The passageways 13 extend through both the top face 11 and the bottom face 12 in the vertical direction. The contact 2 formed by sheet metal, includes a first body 21, a second body 24, a spring arm 22 extends upwardly from the first body 21, a horizontal soldering tail 25 is located under the second body 22. In this embodiment, a plane in which the first body 21 lies, extends along the transverse direction X, and another plane in which the second body 24 lies, extends along the front-to-back direction Y. Understandably, other angled relations between these two planes are feasible as long as those angles are obtuse angles while the right angle may be the best in this embodiment. A connecting section 26 is linked between the first body 21 and the second body 24, and is spaced from the soldering tail 24 in the vertical direction with a distance. Notably, in this embodiment, the passageways 13 in the neighboring rows along the direction X, are offset from each other with a half pitch for molding consideration.

Figure 14:
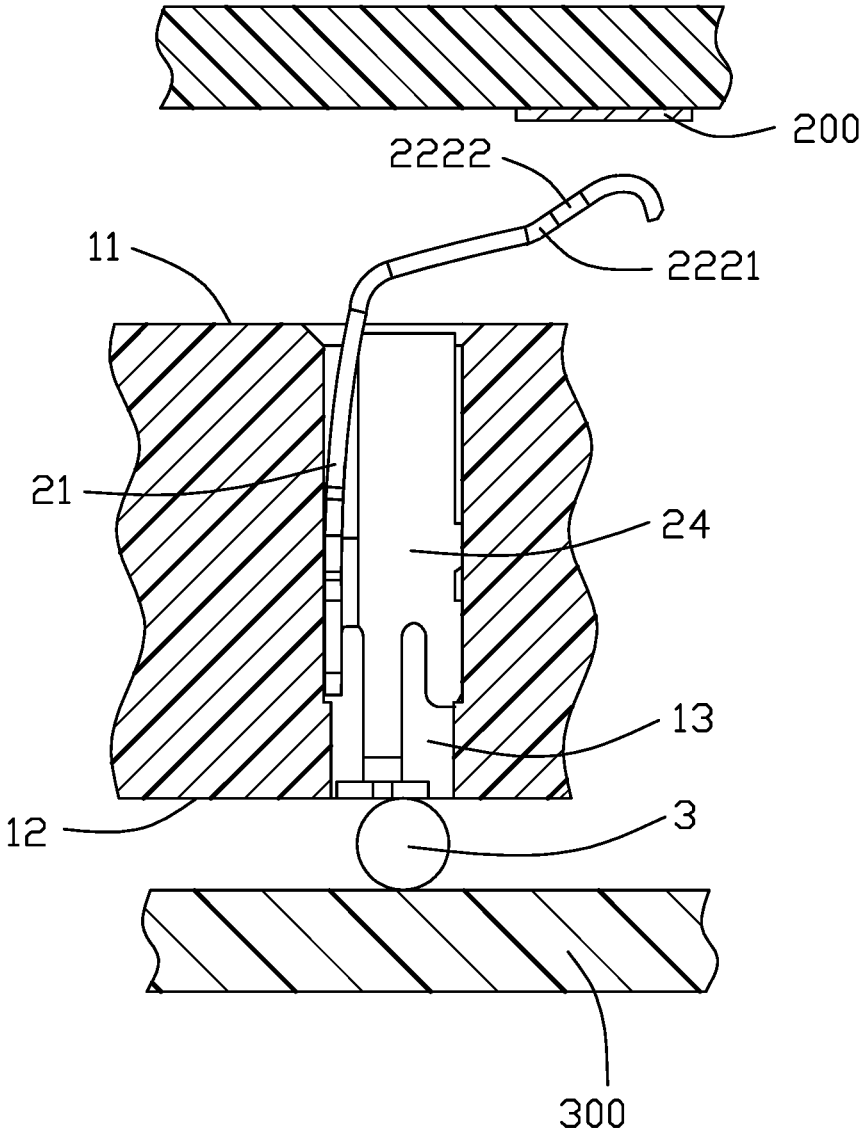
FIG. 14 is a cross-sectional view of a portion of the electrical connector and the associated electronic package and the printed circuit board on which the electrical connector is mounted when the electronic package is spaced from the contact.
Figure 15:
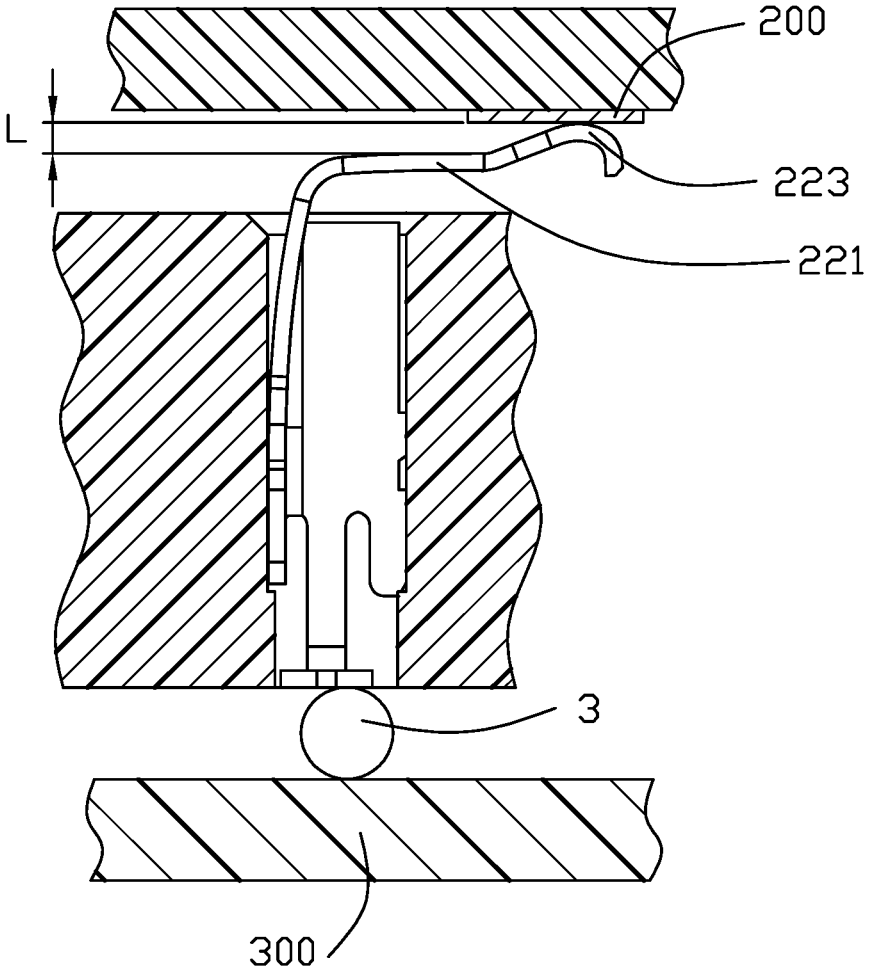
FIG. 15 is a cross-sectional view of the portion of the electrical connector and the associated electronic package and the printed circuit board of FIG. 14, wherein the electronic package is electrically and mechanically connected to the contact.

The spring arm 22 is linked to the first body 21 via a bending section 23. The spring arm 22 includes a plate section 221 connected to the bending section 23 in an obliquely extending manner, and a bulged contacting section 223 upwardly extending from the plate section 221 via a tapered transition section 222. Notably, the width of the plate section 221 is same with that of the first body 21 while larger than that of the contacting section 223. The plate section 221 may provide stability of the spring arm 22 during mating with the electronic package 200. The transition section 222, which is angled with the plate section 221 in a side view as shown in FIGS. 14 and 15, includes a first segment 2221 linked to the plate section 221, and a second segment 2222 linked to the contacting section 223. With the transition section 222, the contact 2 is not only rigid enough around the bottom to be retained in the housing 1 but also soft enough around the top to be downwardly pressed by the electronic package 200.

The spring arm 22 forms an elongated slot 27 along an extension direction thereof around the curved adjoining or bending section 23, and the slot 25 essentially extends from the first body 21 to the spring arm 22 and through the contact 20 in the thickness direction. A width at each end of the slot 27 is larger than that of the remainders thereof. A downward extension is formed on a bottom end of the first body 21 and below the connecting section 26 in the vertical direction. Similarly, a first blade 241 and a second blade 242 are formed on a bottom end of the second body 24 and located below the connecting section 26 in the vertical direction. The soldering tail 25 is formed at the bottom end of the first blade 241. The second blade 242 is shorter than the first blade 241. A slit (not labeled) is formed between the first blade 241 and the second blade 242 with a width around 0.10 mm~0.25 mm, and a length of the second blade 242 is around 0.25 mm~0.40 mm. A first barbed structure 211 is formed on a lateral outer edge of the first body 21, and a second barbed structure 243 is formed on a lateral outer edge of the second body 24. The housing 1 forms a first retention slot 14 and a second retention slot 15 for respectively receiving the first barbed structure 21 and the second barbed structure 243.

When the electronic package 200 is mounted upon the connector 100, the load plate 102 presses downwardly the electronic package 200 to have the electronic package 200 electrically connected with the contacting section 223 of the contacts 2. Because the plate section 221 is essentially parallel to the top face 11, so as to be parallel to the conductive pad of the electronic package 200 with a distance less than 0.12 mm. It is preferred to have the minimum impedance of the contact when such a distance is equal to 0.103 mm.

Notably, in both two embodiments the first body and the second body are perpendicular to each other, and the plate section linked between spring arm and the first body, extends in a horizontal direction either in a compressed manner or a relaxed manner wherein in the first embodiment the first body abuts against the interior wall in the passageway of the housing while in the second embodiment the first body is slightly spaced from the interior wall in the passageway of the housing.

What is claimed is:

1. An electrical connector for use with an electronic package, comprising:

an insulative housing forming opposite top and bottom faces in a vertical direction and a plurality of passageways extending through both said top face and bottom face in the vertical direction;

a plurality of contacts retained in the corresponding passageways, respectively, each of said contacts formed by sheet metal and including:

a first body and a second body sideward spaced from and angled with each other and linked to each other via a connecting section;

a deflectable spring arm extending upwardly from an upper portion of the first body and including a wide plate section adjacent to the first body and a narrow bulged contacting section at a top end thereof; and a horizontal soldering tail located at a bottom end of a blade which extends downwardly from a lower portion of the second body and is located below the connecting section; wherein the plate section is parallel to the top face when the spring arm is either in a relaxed manner without connecting the electronic package or in a compressed manner with connecting the electronic package.

2. The electrical connector as claimed in claim 1, wherein a pair of barbed structures are respectively formed on lateral outer edges of the first body and the second body.

3. The electrical connector as claimed in claim 1, wherein the plate section is parallel to the top face when the contact is downwardly deflected by the electronic package in the compressed manner.

4. The electrical connector as claimed in claim 3, wherein the first body abuts against an interior wall beside the corresponding passageway of the housing.

5. The electrical connector as claimed in claim 3, wherein an upper portion of the first body is spaced from a corresponding interior wall beside the corresponding passageway of the housing.

6. The electrical connector as claimed in claim 1, wherein the first body and the second body are perpendicular to each other viewed along the vertical direction.

7. The electrical connector as claimed in claim 1, wherein a tapered transition section is formed between the plate section and the contacting section.

8. The electrical connector as claimed in claim 7, wherein the plate section is angled with regard to the first body in a side view.

9. The electrical connector as claimed in claim 1, wherein the first body lying in a plane extending in a transverse direction perpendicular to the vertical direction, and the second body lying in another plane extending in a front-to-back direction perpendicular to both the vertical direction and the transverse direction.

10. The electrical connector as claimed in claim 9, wherein the passageways are arranged in rows along the transverse direction, and the passageway of the neighboring rows are offset from each other with a half pitch of the passageways in each row.

11. An electrical connector for use with an electronic package, comprising:

an insulative housing forming opposite top and bottom faces in a vertical direction and a plurality of passageways extending through both said top face and bottom face in the vertical direction;

a plurality of contacts retained in the corresponding passageways, respectively, each of said contacts formed by sheet metal and including:

a first body and a second body sideward spaced from and angled with each other and linked to each other via a connecting section;

a deflectable spring arm extending upwardly from an upper portion of the first body and including a wide plate section adjacent to the first body and a narrow bulged contacting section at a top end thereof; and a horizontal soldering tail located at a bottom end of a blade which extends downwardly from a lower portion of the second body and is located below the connecting section; wherein the first body and the second body are perpendicular to each other viewed along the vertical direction, and the spring arm extends perpendicular to the first body and parallel to the second body viewed along the vertical direction; wherein a pair of barbed structures are respectively formed on lateral outer edges of the first body and the second body.

12. The electrical connector as claimed in claim 11, wherein the first body lying in a plane extending in a transverse direction perpendicular to the vertical direction, and the second body lying in another plane extending in a front-to-back direction perpendicular to both the vertical direction and the transverse direction.

13. The electrical connector as claimed in claim 12, wherein the passageways are arranged in rows along the transverse direction, and the passageway of the neighboring rows are offset from each other with a half pitch of the passageways in each row.

14. The electrical connector as claimed in claim 11, wherein a tapered transition section is formed between the plate section and the contacting section.

15. The electrical connector as claimed in claim 14, wherein the plate section is angled with regard to the first body in a side view.

16. An electrical connector assembly comprising:

an electrical connector sandwiched between an electronic package and a printed circuit board;

said electrical connector including:

an insulative housing forming opposite top and bottom faces in a vertical direction and a plurality of passageways extending through both said top face and bottom face in the vertical direction;

a plurality of contacts retained in the corresponding passageways, respectively, each of said contacts formed by sheet metal and including:

a first body and a second body sideward spaced from and angled with each other and linked to each other via a connecting section;

a deflectable spring arm extending upwardly from an upper portion of the first body and including a plate section adjacent to the first body and a bulged contacting section at a top end thereof; and a horizontal soldering tail located at a bottom end of a blade which extends downwardly from a lower portion of the second body and is located below the connecting section; wherein the plate section is parallel to both the electronic package and the printed circuit board when the spring arm is in a compressed manner.

17. The electrical connector assembly as claimed in claim 16, wherein the first body abuts against an interior wall facing the corresponding passageway in the housing.

18. The electrical connector assembly as claimed in claim 16, wherein a pair of barbed structures are respectively formed on lateral outer edges of the first body and the second body.

19. The electrical connector assembly as claimed in claim 16, wherein a through slot is formed in the spring arm of each of said contacts, and a width of the contacting section is similar to that of the slot.

* * * * *